US006173722B1

(12) United States Patent
Ko

(10) Patent No.: US 6,173,722 B1
(45) Date of Patent: Jan. 16, 2001

(54) SIMPLIFIED PULLING ROPE SYSTEM USED FOR MULTIPLE COLLAPSIBLE UMBRELLAS

(76) Inventor: Chin-Sung Ko, No. 21-1, Sec. 3, Chin Mar Road, Changhua (TW)

( * ) Notice: Under 35 U.S.C. 154(b), the term of this patent shall be extended for 0 days.

(21) Appl. No.: 09/421,549

(22) Filed: Oct. 20, 1999

(51) Int. Cl.[7] ..... A45B 25/14
(52) U.S. Cl. ..... 135/22; 135/24
(58) Field of Search ..... 135/22, 24, 20.3, 135/25.1, 25.4, 127

(56) References Cited

U.S. PATENT DOCUMENTS 4,941,494 * 7/1990 Wu ..... 135/24 X
5,178,174 * 1/1993 Wu ..... 135/24 X
5,492,140 * 2/1996 Lin et al. ..... 135/24
5,740,823 * 4/1998 Lin et al. ..... 135/22 X
5,823,214 * 10/1998 Seidel ..... 135/22

* cited by examiner

*Primary Examiner*—James O. Hansen
(74) *Attorney, Agent, or Firm*—Rosenberg, Klein & Lee

(57) ABSTRACT

A simplified pulling rope system used in multiple collapsible umbrellas comprises a mounting block and a pulley arranged on the upper portion of an umbrella rod, two rollers individually disposed on two sides of an umbrella runner, and a pulling rope one end of which is connected to a bullet-shaped element and the other end extends through the aforesaid pulley, rollers and mounting block and is finally attached to the bottom of an umbrella cap. The pulling rope system according to the invention used in a fully automatic umbrella has excellent efficiency.

1 Claim, 5 Drawing Sheets

SIMPLIFIED PULLING ROPE SYSTEM USED FOR MULTIPLE COLLAPSIBLE UMBRELLAS

BACKGROUND OF THE INVENTION

Prior art fully automatic umbrella structures typically use two pulling ropes and two or more pulleys disposed the upper portion of the umbrella rod in conjunction with a governing mechanism located in the umbrella handle and a bullet-shaped moving element located in the umbrella rod to automatically open or close an umbrella. To simplify umbrella structures, a known improved design used a single pulling rope to perform the same function. However, such a structure must employ more pulleys to change the extending directions of the pulling rope because that the pulling rope must make many turns in the system. It provides inconvenience and trouble in manufacturing and assembling as well as a higher defect rate.

In view of the above problems, the present invention is to provide an improved pulling rope system used in a fully automatic umbrella that uses a combination of a single pulling rope and a pulley to accomplish the opening and closing operations of an umbrella. Now the features and advantages of the invention will be detailed with reference to the accompanying drawings.

BRIEF DESCRIPTION OF ACCOMPANYING DRAWINGS

DETAILED DESCRIPTION OF PREFERRED EMBODIMENTS

Figure 1:
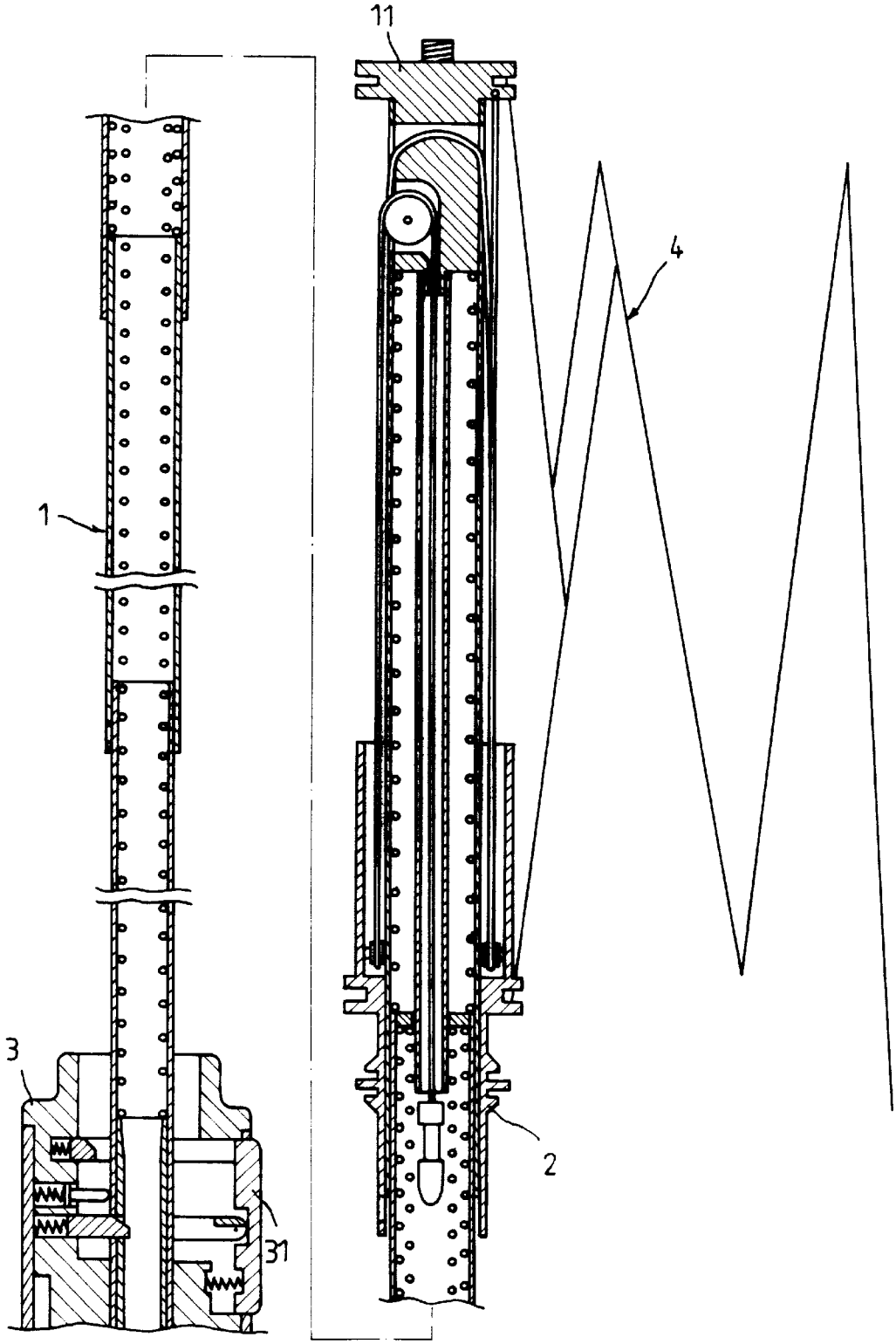
FIG. 1 is a cross sectional plan view showing the pulling rope system of an umbrella according to the invention in a state that the umbrella is closed.
Figure 2:
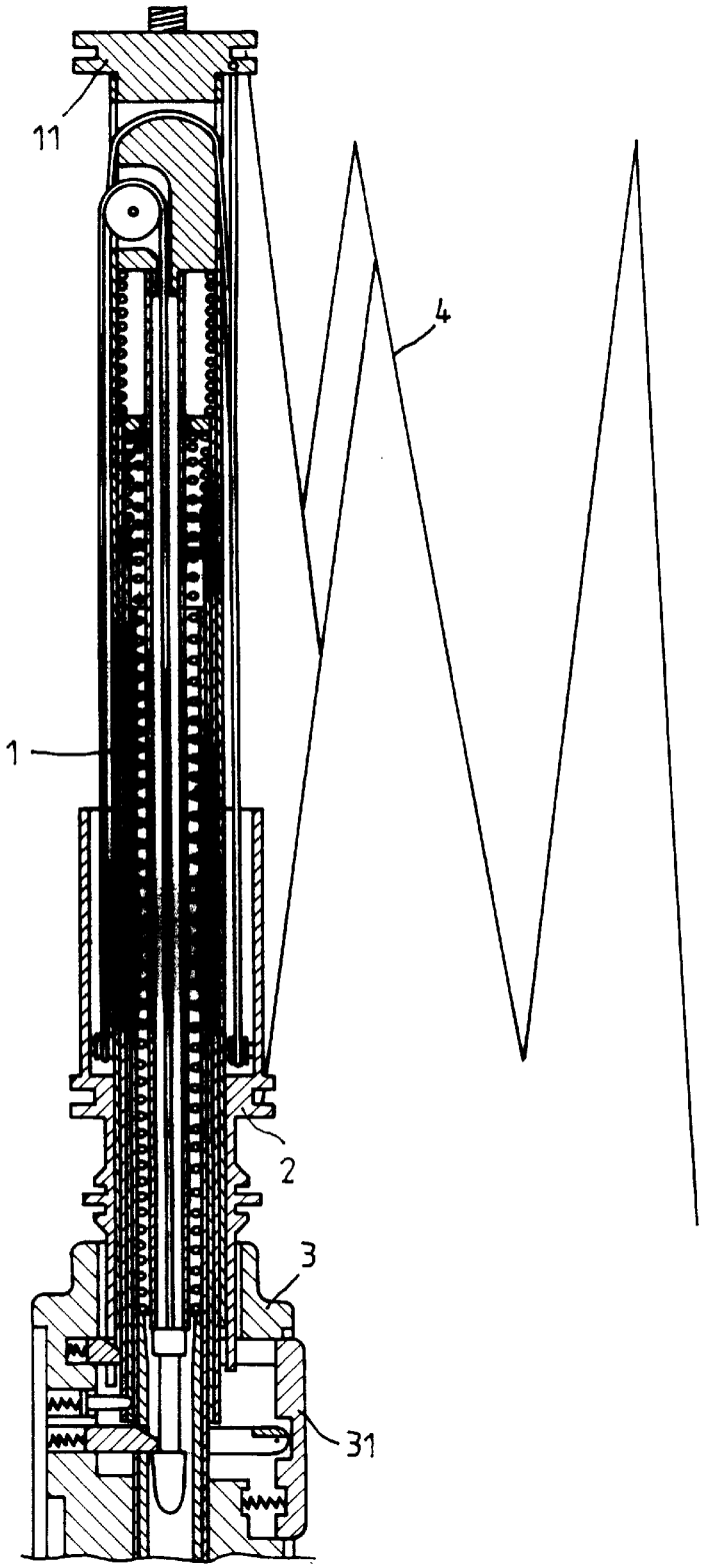
FIG. 2 is a cross sectional plan view showing the pulling rope system of FIG. 1 in a state that the umbrella is collapsed.
Figure 3:
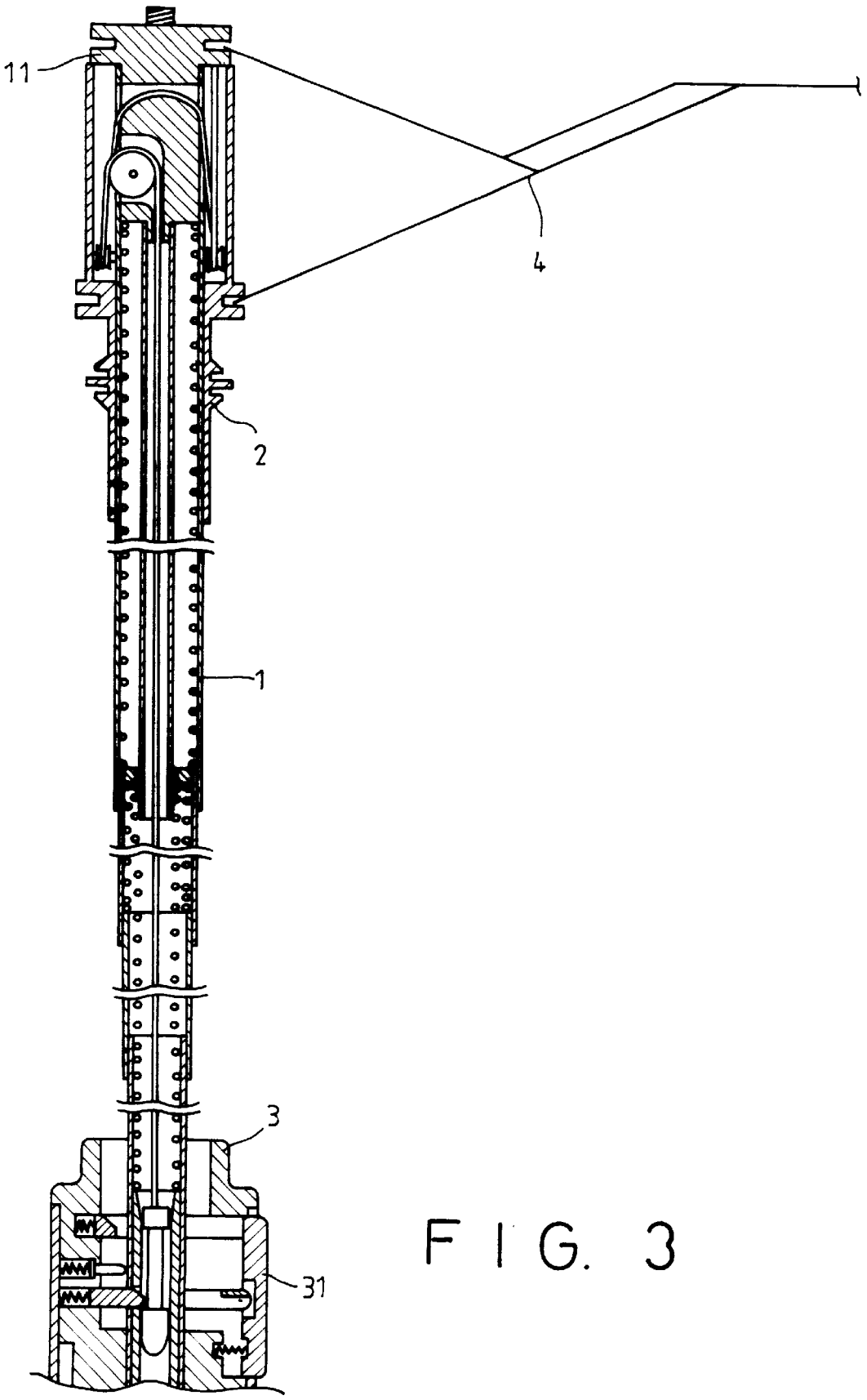
FIG. 3 is a cross sectional view showing the pulling rope system of FIG. 1 in a state that the umbrella is opened.

With reference to FIGS. 1 through 3, a pulling rope system used in a full automatic collapsible umbrella according to the invention comprises an umbrella rod (1) that is provided with a cap (11) on the top, a runner (2) slidably mounting over the umbrella rod, and a handle (3) attached to the bottom end. An umbrella stretcher system (4) is pivoted to the cap (11) and the runner (2) respectively through umbrella stretchers and struts. With the motion of the runner (2), the umbrella can be opened and closed. The above structure has been known to the public. The umbrella is operated as follows. Initially the umbrella rod (1) is collapsed as shown in FIG. 2. To open the umbrella, users depress a button (31) disposed on the handle (3) as shown in FIG. 3. When the button (31) is depressed again, the umbrella closes as shown in FIG. 1. The above structure is not included in the scope of the invention and thus it will not be detailed here.

Figure 4:
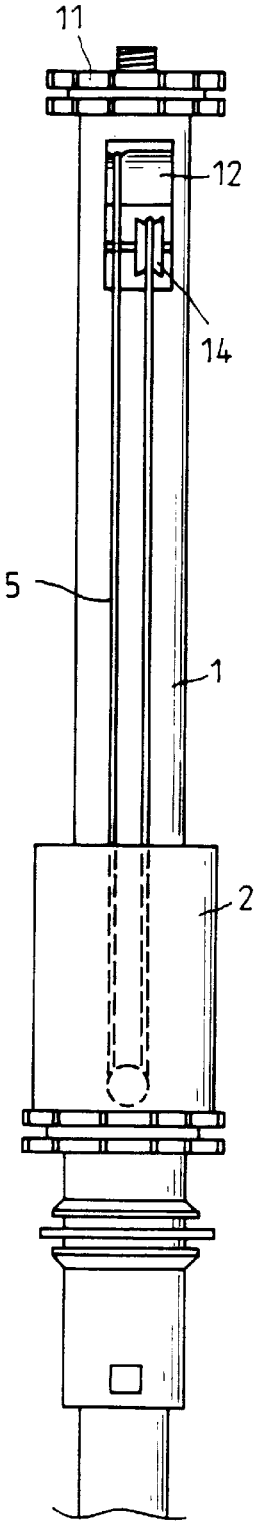
FIG. 4 is a plan view partially indicating the structure of the pulling rope system of the invention.
Figure 5:
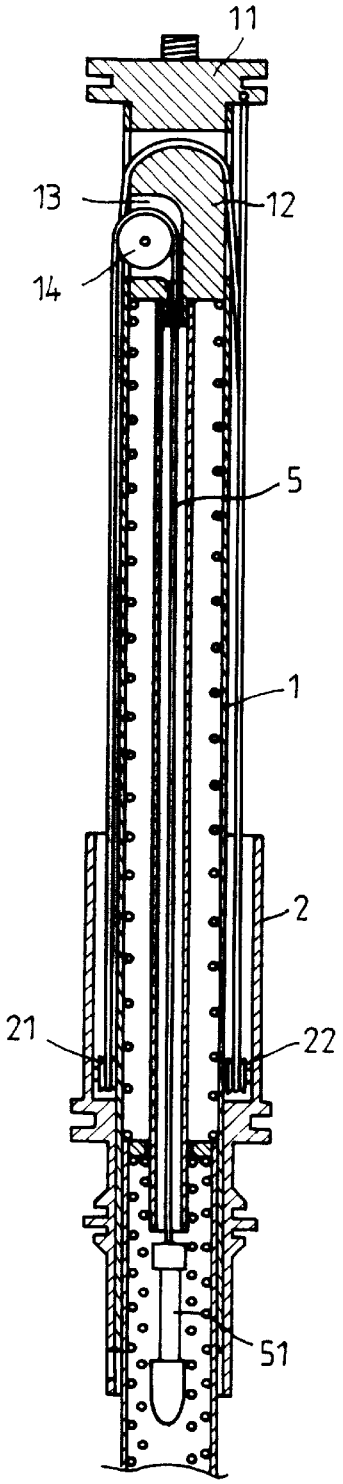
FIG. 5 is a left-handed side view of the pulling rope system of FIG. 4.
Figure 6:
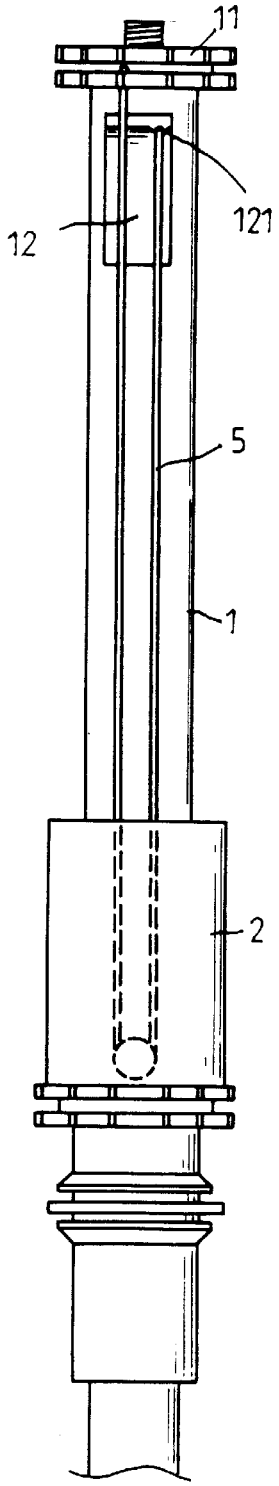
FIG. 6 is a right-handed side view of the pulling rope system of FIG. 4.

The invention emphasizes the design of pulling ropes (5) that governs the operation of an umbrella. The pulling rope (5) is connected on one end to a bullet-shaped element (51) and upwardly extends on the other end and, after making several turns, is finally attached to the bottom of the cap (11). Referring to FIGS. 4 through 6, the invention is featured by a mounting block (12) that is provided with a round groove (121) and an opening (13) that houses a pulley (14) therein. The runner (2) is provided on two sides each with a roller (21) and (22). The pulling rope (5) upwardly extends from the bullet-shaped element (51) and is first passed around the pulley (14) and then continues extending to the roller (21). The rope is wrapped around the roller (21) and then passes through the round groove (121) of the mounting block (12) and, after making a turn around the roller (22), is finally attached to the bottom of the umbrella cap (11).

Figure 7:
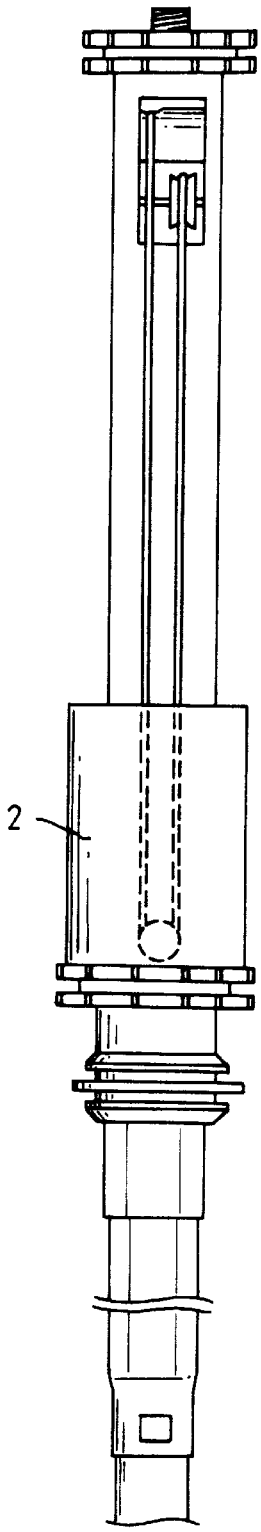
FIG. 7 is a plan view similar to FIG. 4 of which the runner with a shorter bottom end of the invention.
Figure 8:
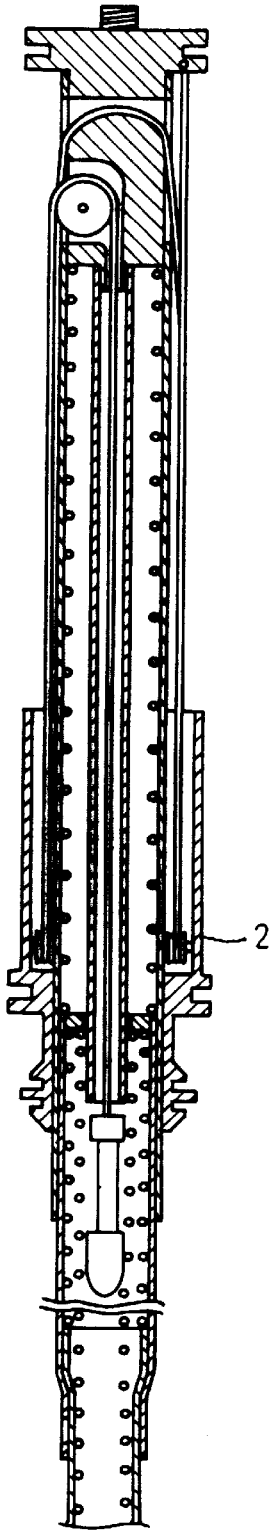
FIG. 8 is a left-handed side view of the pulling rope system of FIG. 7.

FIGS. 7 and 8 show another embodiment of this invention which has the runner with a shorter bottom end and an engaged hole is formed of the middle tube of the shaft.

According to the invention, with only a mounting block on the upper portion of the umbrella rod and a single pulley housed in the mounting block, the structure provides a reliable guide to the pulling rope. Therefore, under the control of the pulling rope, the runner can slide smoothly to open or close an umbrella. Evidently the invention is valuable in industry and has the essence of a patent. Thus we hereby file an application for a patent grant.

What is claimed is:

1. A simplified pulling rope system used for multiple collapsible umbrellas comprising an umbrella rod that is provided with a cap on the top thereof, a runner slidably mounting over the umbrella rod, a handle attached to a bottom end of said umbrella rod, and an umbrella stretcher system pivoted to the cap and the runner respectively through umbrella stretchers and struts; said pulling rope system characterized in that an upper portion of the umbrella rod includes a mounting block having a round groove and an opening that houses a pulley therein, the runner being provided on two sides with a first and second roller respectively, a pulling rope being connected on one end to a bullet-shaped element and upwardly extending on the other end around the pulley and continuing toward said first roller on one side of the runner, the pulling rope is further wrapped around said first roller and continuing toward said mounting block, said pulling rope then passes through the round groove of the mounting block and said second said pulling rope, after making a turn around said second roller, said pulling rope is finally attached to a bottom of the umbrella cap; said pulling rope urging the sliding motion of said runner to open or close the umbrella.

* * * * *